US010662966B2

(12) United States Patent
Hancock

(10) Patent No.: US 10,662,966 B2
(45) Date of Patent: May 26, 2020

(54) BLOWER HOUSING LABYRINTH SEAL

(71) Applicant: Trane International Inc., Davidson, NC (US)

(72) Inventor: Stephen Stewart Hancock, Flint, TX (US)

(73) Assignee: Trane International Inc., Davidson, NC (US)

( * ) Notice: Subject to any disclaimer, the term of this patent is extended or adjusted under 35 U.S.C. 154(b) by 423 days.

(21) Appl. No.: 15/368,003

(22) Filed: Dec. 2, 2016

(65) Prior Publication Data

US 2018/0156228 A1 Jun. 7, 2018

(51) Int. Cl.

| | |
|---|---|
| ***F04D 29/28*** | (2006.01) |
| ***F04D 29/16*** | (2006.01) |
| ***F04D 17/16*** | (2006.01) |
| *F24F 7/06* | (2006.01) |

(52) U.S. Cl.

CPC ..... *F04D 29/162* (2013.01); *F04D 17/162* (2013.01); *F04D 29/281* (2013.01); *F04D 29/283* (2013.01); *F24F 7/06* (2013.01)

(58) Field of Classification Search

CPC .... F04D 29/162; F04D 17/162; F04D 29/281; F04D 17/16; F04D 29/4206; F04D 29/4213; F04D 29/283

See application file for complete search history.

(56) References Cited

U.S. PATENT DOCUMENTS

| | | | | |
|---|---|---|---|---|
| 1,056,813 | A | 3/1913 | McLean | |
| 3,306,528 | A | 2/1967 | Eck | |
| 5,551,838 | A | 9/1996 | Hugbart | |
| 5,570,996 | A | 11/1996 | Smiley, III | |
| 6,450,765 | B1 | 9/2002 | Carroll et al. | |
| 6,591,516 | B2 | 7/2003 | Kamada et al. | |
| 6,755,615 | B2 * | 6/2004 | Chapman | F04D 29/023 415/206 |
| 7,014,422 | B2 | 3/2006 | Hancock | |
| 7,108,478 | B2 * | 9/2006 | Hancock | F04D 17/02 415/108 |
| 7,144,219 | B2 | 12/2006 | Hancock | |
| D537,517 | S | 2/2007 | Hancock | |

(Continued)

OTHER PUBLICATIONS

Hancock, Stephen Stewart; U.S. Appl. No. 15/609,923, filed May 31, 2017; Title: Momentum Based Blower Interstitial Seal; 37 pages.

Hancock, Stephen Stewart; U.S. Appl. No. 15/594,028, filed May 12, 2017; Title: Blower Housing with Two Position Cutoff; 33 pages.

Final Office Action dated Jul. 11, 2019; U.S. Appl. No. 15/609,923, filed May 31, 2017; 16 pages.

(Continued)

*Primary Examiner* — David E Sosnowski
*Assistant Examiner* — Sabbir Hasan
(74) *Attorney, Agent, or Firm* — Conley Rose, P.C.; J. Roberts Brown, Jr.; Kristian R. Sullivan

(57) ABSTRACT

A heating, ventilation, and/or air conditioning (HVAC) system includes a blower assembly having a blower housing, a motor disposed at least partially within the blower housing, and an impeller comprising a plurality of blades disposed about the impeller that is connected to the motor by a shaft. The blower assembly includes a labyrinth seal that provides a tortuous leakage airflow path between the blower housing and the impeller to substantially reduce the amount of air that escapes from the blower housing between the blower housing and the impeller to provide an increased blower efficiency as compared to traditional blower assemblies.

20 Claims, 6 Drawing Sheets

(56) References Cited

U.S. PATENT DOCUMENTS

| | | | | |
|---|---|---|---|---|
| 7,591,633 | B2 | 9/2009 | Hancock | |
| 7,748,954 | B2 * | 7/2010 | Eguchi | F04D 29/282 415/119 |
| 8,602,723 | B2 | 12/2013 | Chou et al. | |
| 9,039,363 | B2 | 5/2015 | Hancock | |
| 9,188,137 | B2 | 11/2015 | Hancock | |
| 9,279,429 | B2 | 3/2016 | Hancock | |
| 2005/0163614 | A1 | 7/2005 | Chapman | |
| 2007/0059167 | A1 | 3/2007 | Hancock | |
| 2008/0095629 | A1 | 4/2008 | Eguchi et al. | |
| 2013/0209245 | A1 | 8/2013 | Iyer et al. | |
| 2015/0330394 | A1 | 11/2015 | Cocks et al. | |
| 2016/0177810 | A1 | 6/2016 | Gullberg et al. | |
| 2017/0051749 | A1 | 2/2017 | Cho et al. | |

OTHER PUBLICATIONS

Office Action dated Jun. 6, 2019; U.S. Appl. No. 15/594,028, filed May 12, 2017; 8 pages.

Custom Air Products & Servcies, Inc. (CAPS); "What is an Air Handling Unit (AHU)?" Retrieved from: https://customairproducts.com/what-is-an-air-handling-unit-ahu/; Nov. 6, 2013; 2 pages.

Office Action dated Aug. 23, 2019; U.S. Appl. No. 15/594,028, filed May 12, 2017; 20 pages.

Office Action dated Jan. 14, 2019; U.S. Appl. No. 15/609,923, filed May 31, 2017; 15 pages.

Final Office Action dated Dec. 20, 2019; U.S. Appl. No. 15/594,028, filed May 12, 2017; 24 pages.

Notice of Allowance dated Mar. 18, 2020; U.S. Appl. No. 15/594,028, filed May 12, 2017; 13 pages.

* cited by examiner

BLOWER HOUSING LABYRINTH SEAL

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Heating, ventilation, and/or air conditioning (HVAC) systems may generally be used in residential and/or commercial structures to provide heating and/or cooling in order to create comfortable conditions inside climate conditioned areas associated with such structures. To provide an airflow of conditioned air into such conditioned areas, most HVAC systems employ a fan to move the conditioned air through the HVAC system and into the climate conditioned areas.

SUMMARY OF THE DISCLOSURE

In some embodiments, a blower assembly is disclosed as comprising: a blower housing; and an impeller; wherein the blower housing and the impeller are configured to provide a labyrinth seal that provides a tortuous leakage airflow path between the blower housing and the impeller.

In other embodiments, a heating, ventilation, and/or air conditioning (HVAC) system is disclosed as comprising: a component; and a blower assembly configured to generate an airflow through the component, the blower assembly comprising: a blower housing; and an impeller; wherein the blower housing and the impeller are configured to provide a labyrinth seal that provides a tortuous leakage airflow path between the blower housing and the impeller.

In yet other embodiments of the disclosure, a method of operating a blower assembly is disclosed as comprising: providing a blower assembly comprising a blower housing and an impeller; operating a motor of the blower assembly to rotate the impeller about an axis to draw an airflow into at least one air input of the blower housing; and preventing at least a portion of the airflow from the blower housing from escaping the blower housing between the blower housing and the impeller by providing a labyrinth seal at least partially disposed between the blower housing and the impeller, wherein the labyrinth seal is configured to provide a tortuous leakage airflow path between the blower housing and the impeller.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION

In some cases, it may be desirable to provide a heating, ventilation, and/or air conditioning (HVAC) system with a blower assembly having a labyrinth seal that provides a tortuous leakage airflow path between the blower housing and the impeller. For example, in HVAC systems seeking to maximize efficiency, it may be desirable to reduce the amount of air that may escape from a blower assembly between the blower housing and the impeller intake to provide an increased efficiency as compared to traditional blower assemblies. By reducing the amount of air that escapes between the blower housing and the impeller intake, the labyrinth seal may allow the blower assembly to generate an increased amount of airflow through the HVAC system, which may increase heat transfer between the airflow and heat exchange components of the HVAC system, thus increasing the overall efficiency of the HVAC system. Alternatively, the reduced leakage may reduce the fan power needed to move a given amount of airflow through the HVAC system to increase the overall efficiency of the HVAC system. In some embodiments, the blower assembly comprising the labyrinth seal may be a component of an air handling unit. However, in some embodiments, the blower assembly comprising the labyrinth seal may be a component of a gas-fired furnace. In yet other embodiments, the blower assembly comprising the labyrinth seal may be a component of any other component and/or system of an HVAC system.

Figure 1:
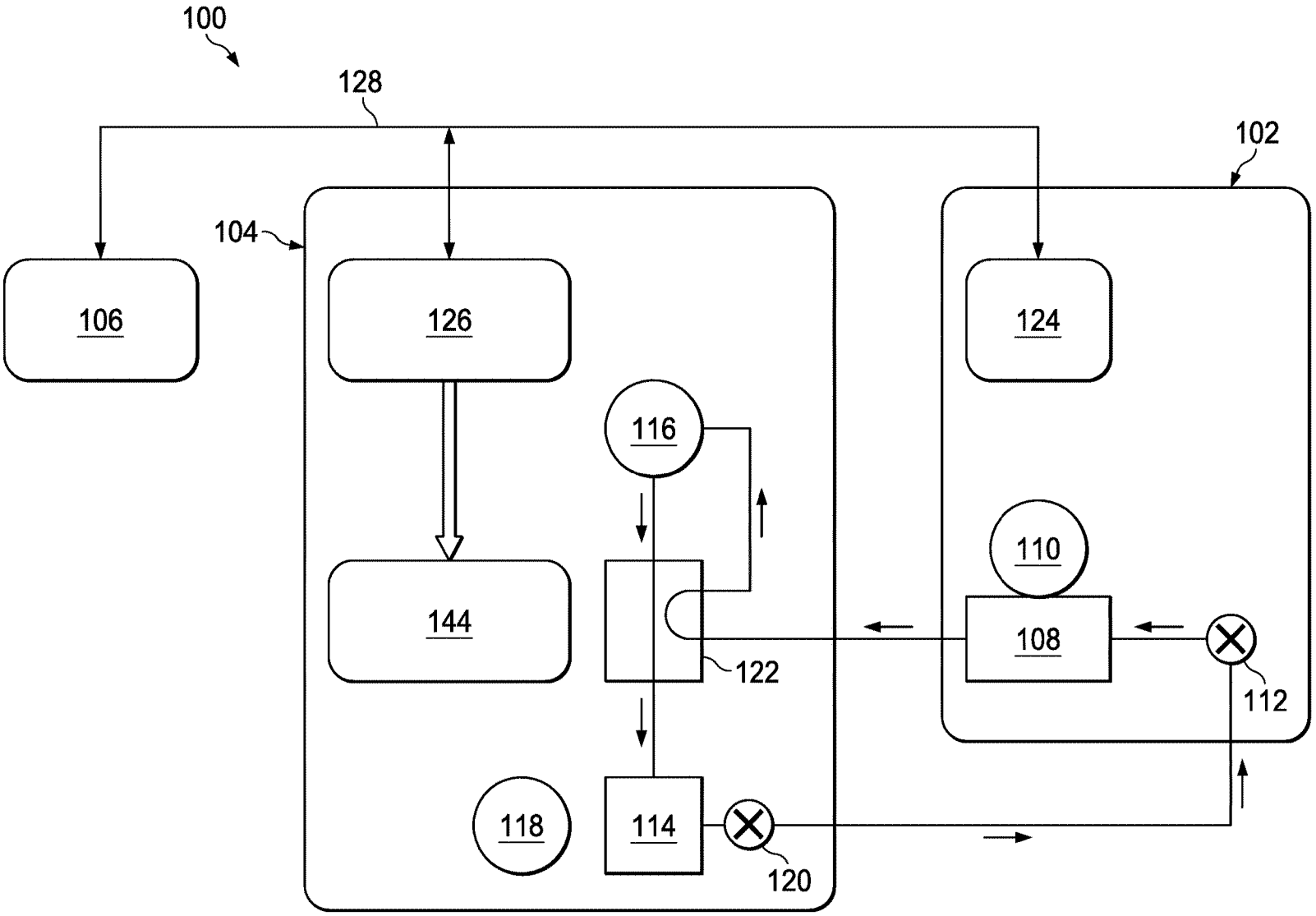
FIG. 1 is a schematic diagram of a heating, ventilation, and/or air conditioning (HVAC) system according to an embodiment of the disclosure.

Referring now to FIG. 1, a schematic diagram of a heating, ventilation, and/or air conditioning (HVAC) system 100 is shown according to an embodiment of the disclosure. Most generally, HVAC system 100 comprises a heat pump system that may be selectively operated to implement one or more substantially closed thermodynamic refrigeration cycles to provide a cooling functionality (hereinafter "cooling mode") and/or a heating functionality (hereinafter "heating mode"). The HVAC system 100, configured as a heat pump system, generally comprises an indoor unit 102, an outdoor unit 104, and a system controller 106 that may generally control operation of the indoor unit 102 and/or the outdoor unit 104.

Indoor unit 102 generally comprises an indoor air handling unit comprising an indoor heat exchanger 108, an indoor fan 110, an indoor metering device 112, and an indoor controller 124. The indoor heat exchanger 108 may generally be configured to promote heat exchange between refrigerant carried within internal tubing of the indoor heat exchanger 108 and an airflow that may contact the indoor heat exchanger 108 but that is segregated from the refrigerant. In some embodiments, the indoor heat exchanger 108 may comprise a plate-fin heat exchanger. However, in other embodiments, indoor heat exchanger 108 may comprise a microchannel heat exchanger and/or any other suitable type of heat exchanger.

The indoor fan 110 may generally comprise a variable speed blower comprising a blower housing, a blower impeller at least partially disposed within the blower housing, and a blower motor configured to selectively rotate the blower impeller. The indoor fan 110 may generally be configured to provide airflow through the indoor unit 102 and/or the indoor heat exchanger 108 to promote heat transfer between the airflow and a refrigerant flowing through the indoor heat exchanger 108. The indoor fan 110 may also be configured to deliver temperature-conditioned air from the indoor unit 102 to one or more areas and/or zones of a climate controlled structure. The indoor fan 110 may generally be configured as a modulating and/or variable speed fan capable of being operated at many speeds over one or more ranges of speeds. In other embodiments, the indoor fan 110 may be configured as a multiple speed fan capable of being operated at a plurality of operating speeds by selectively electrically powering different ones of multiple electromagnetic windings of a motor of the indoor fan 110. In yet other embodiments, however, the indoor fan 110 may be a single speed fan.

The indoor metering device 112 may generally comprise an electronically-controlled motor-driven electronic expansion valve (EEV). In some embodiments, however, the indoor metering device 112 may comprise a thermostatic expansion valve, a capillary tube assembly, and/or any other suitable metering device. In some embodiments, while the indoor metering device 112 may be configured to meter the volume and/or flow rate of refrigerant through the indoor metering device 112, the indoor metering device 112 may also comprise and/or be associated with a refrigerant check valve and/or refrigerant bypass configuration when the direction of refrigerant flow through the indoor metering device 112 is such that the indoor metering device 112 is not intended to meter or otherwise substantially restrict flow of the refrigerant through the indoor metering device 112.

Outdoor unit 104 generally comprises an outdoor heat exchanger 114, a compressor 116, an outdoor fan 118, an outdoor metering device 120, a reversing valve 122, and an outdoor controller 126. In some embodiments, the outdoor unit 104 may also comprise a plurality of temperature sensors for measuring the temperature of the outdoor heat exchanger 114, the compressor 116, and/or the outdoor ambient temperature. The outdoor heat exchanger 114 may generally be configured to promote heat transfer between a refrigerant carried within internal passages of the outdoor heat exchanger 114 and an airflow that contacts the outdoor heat exchanger 114 but that is segregated from the refrigerant. In some embodiments, outdoor heat exchanger 114 may comprise a plate-fin heat exchanger. However, in other embodiments, outdoor heat exchanger 114 may comprise a spine-fin heat exchanger, a microchannel heat exchanger, or any other suitable type of heat exchanger.

The compressor 116 may generally comprise a variable speed scroll-type compressor that may generally be configured to selectively pump refrigerant at a plurality of mass flow rates through the indoor unit 102, the outdoor unit 104, and/or between the indoor unit 102 and the outdoor unit 104. In some embodiments, the compressor 116 may comprise a rotary type compressor configured to selectively pump refrigerant at a plurality of mass flow rates. In alternative embodiments, however, the compressor 116 may comprise a modulating compressor that is capable of operation over a plurality of speed ranges, a reciprocating-type compressor, a single speed compressor, and/or any other suitable refrigerant compressor and/or refrigerant pump. In some embodiments, the compressor 116 may be controlled by a compressor drive controller 144, also referred to as a compressor drive and/or a compressor drive system.

The outdoor fan 118 may generally comprise an axial fan comprising a fan blade assembly and fan motor configured to selectively rotate the fan blade assembly. The outdoor fan 118 may generally be configured to provide airflow through the outdoor unit 104 and/or the outdoor heat exchanger 114 to promote heat transfer between the airflow and a refrigerant flowing through the outdoor heat exchanger 114. The outdoor fan 118 may generally be configured as a modulating and/or variable speed fan capable of being operated at a plurality of speeds over a plurality of speed ranges. In other embodiments, the outdoor fan 118 may comprise a mixed-flow fan, a centrifugal blower, and/or any other suitable type of fan and/or blower, such as a multiple speed fan capable of being operated at a plurality of operating speeds by selectively electrically powering different multiple electromagnetic windings of a motor of the outdoor fan 118. In yet other embodiments, the outdoor fan 118 may be a single speed fan. Further, in other embodiments, however, the outdoor fan 118 may comprise a mixed-flow fan, a centrifugal blower, and/or any other suitable type of fan and/or blower.

The outdoor metering device 120 may generally comprise a thermostatic expansion valve. In some embodiments, however, the outdoor metering device 120 may comprise an electronically-controlled motor driven EEV similar to indoor metering device 112, a capillary tube assembly, and/or any other suitable metering device. In some embodiments, while the outdoor metering device 120 may be configured to meter the volume and/or flow rate of refrigerant through the outdoor metering device 120, the outdoor metering device 120 may also comprise and/or be associated with a refrigerant check valve and/or refrigerant bypass configuration when the direction of refrigerant flow through the outdoor metering device 120 is such that the outdoor metering device 120 is not intended to meter or otherwise substantially restrict flow of the refrigerant through the outdoor metering device 120.

The reversing valve 122 may generally comprise a four-way reversing valve. The reversing valve 122 may also comprise an electrical solenoid, relay, and/or other device configured to selectively move a component of the reversing valve 122 between operational positions to alter the flowpath of refrigerant through the reversing valve 122 and consequently the HVAC system 100. Additionally, the reversing valve 122 may also be selectively controlled by the system controller 106 and/or an outdoor controller 126.

The system controller 106 may generally be configured to selectively communicate with an indoor controller 124 of the indoor unit 102, an outdoor controller 126 of the outdoor unit 104, and/or other components of the HVAC system 100. In some embodiments, the system controller 106 may be configured to control operation of the indoor unit 102 and/or the outdoor unit 104. In some embodiments, the system controller 106 may be configured to monitor and/or communicate with a plurality of temperature sensors associated with components of the indoor unit 102, the outdoor unit 104, and/or the ambient outdoor temperature. Additionally, in some embodiments, the system controller 106 may comprise a temperature sensor and/or a humidity sensor and/or may further be configured to control heating and/or cooling of zones associated with the HVAC system 100. In other embodiments, however, the system controller 106 may be configured as a thermostat for controlling the supply of conditioned air to zones associated with the HVAC system 100.

The system controller 106 may also generally comprise a touchscreen interface for displaying information and for receiving user inputs. The system controller 106 may display information related to the operation of the HVAC system 100 and may receive user inputs related to operation of the HVAC system 100. However, the system controller 106 may further be operable to display information and receive user inputs tangentially and/or unrelated to operation of the HVAC system 100. In some embodiments, however, the system controller 106 may not comprise a display and may derive all information from inputs from remote sensors and remote configuration tools.

In some embodiments, the system controller 106 may be configured for selective bidirectional communication over a communication bus 128. In some embodiments, portions of the communication bus 128 may comprise a three-wire connection suitable for communicating messages between the system controller 106 and one or more of the HVAC system 100 components configured for interfacing with the communication bus 128.

The indoor controller 124 may be carried by the indoor unit 102 and may generally be configured to receive information inputs, transmit information outputs, and/or otherwise communicate with the system controller 106, the outdoor controller 126, and/or any other device via the communication bus 128 and/or any other suitable medium of communication. In some embodiments, the indoor controller 124 may be configured to receive information related to a speed of the indoor fan 110, transmit a control output to an auxiliary heat source, transmit information regarding an indoor fan 110 volumetric flow-rate, communicate with and/or otherwise affect control over an air cleaner, and communicate with an indoor EEV controller. In some embodiments, the indoor controller 124 may be configured to communicate with an indoor fan 110 controller and/or otherwise affect control over operation of the indoor fan 110.

The outdoor controller 126 may be carried by the outdoor unit 104 and may be configured to receive information inputs, transmit information outputs, and/or otherwise communicate with the system controller 106, the indoor controller 124, and/or any other device via the communication bus 128 and/or any other suitable medium of communication. In some embodiments, the outdoor controller 126 may be configured to receive information related to an ambient temperature associated with the outdoor unit 104, information related to a temperature of the outdoor heat exchanger 114, and/or information related to refrigerant temperatures and/or pressures of refrigerant entering, exiting, and/or within the outdoor heat exchanger 114 and/or the compressor 116. In some embodiments, the outdoor controller 126 may be configured to transmit information related to monitoring, communicating with, and/or otherwise affecting control over the compressor 116, the outdoor fan 118, a solenoid of the reversing valve 122, a relay associated with adjusting and/or monitoring a refrigerant charge of the HVAC system 100, a position of the indoor metering device 112, and/or a position of the outdoor metering device 120. The outdoor controller 126 may further be configured to communicate with and/or control a compressor drive controller 144 that is configured to electrically power and/or control the compressor 116.

The HVAC system 100 is shown configured for operating in a so-called cooling mode in which heat is absorbed by refrigerant at the indoor heat exchanger 108 and heat is rejected from the refrigerant at the outdoor heat exchanger 114. In some embodiments, the compressor 116 may be operated to compress refrigerant and pump the relatively high temperature and high pressure compressed refrigerant from the compressor 116 to the outdoor heat exchanger 114 through the reversing valve 122 and to the outdoor heat exchanger 114. As the refrigerant is passed through the outdoor heat exchanger 114, the outdoor fan 118 may be operated to move air into contact with the outdoor heat exchanger 114, thereby transferring heat from the refrigerant to the air surrounding the outdoor heat exchanger 114. The refrigerant may primarily comprise liquid phase refrigerant and the refrigerant may flow from the outdoor heat exchanger 114 to the indoor metering device 112 through and/or around the outdoor metering device 120 which does not substantially impede flow of the refrigerant in the cooling mode. The indoor metering device 112 may meter passage of the refrigerant through the indoor metering device 112 so that the refrigerant downstream of the indoor metering device 112 is at a lower pressure than the refrigerant upstream of the indoor metering device 112. The pressure differential across the indoor metering device 112 allows the refrigerant downstream of the indoor metering device 112 to expand and/or at least partially convert to a two-phase (vapor and gas) mixture. The two-phase refrigerant may enter the indoor heat exchanger 108. As the refrigerant is passed through the indoor heat exchanger 108, the indoor fan 110 may be operated to move air into contact with the indoor heat exchanger 108, thereby transferring heat to the refrigerant from the air surrounding the indoor heat exchanger 108, and causing evaporation of the liquid portion of the two-phase mixture. The refrigerant may thereafter re-enter the compressor 116 after passing through the reversing valve 122.

To operate the HVAC system 100 in the so-called heating mode, the reversing valve 122 may be controlled to alter the flow path of the refrigerant, the indoor metering device 112 may be disabled and/or bypassed, and the outdoor metering device 120 may be enabled. In the heating mode, refrigerant may flow from the compressor 116 to the indoor heat exchanger 108 through the reversing valve 122, the refrigerant may be substantially unaffected by the indoor metering device 112, the refrigerant may experience a pressure differential across the outdoor metering device 120, the refrigerant may pass through the outdoor heat exchanger 114, and the refrigerant may re-enter the compressor 116 after passing through the reversing valve 122. Most generally, operation of the HVAC system 100 in the heating mode reverses the roles of the indoor heat exchanger 108 and the outdoor heat exchanger 114 as compared to their operation in the cooling mode.

Figure 2:
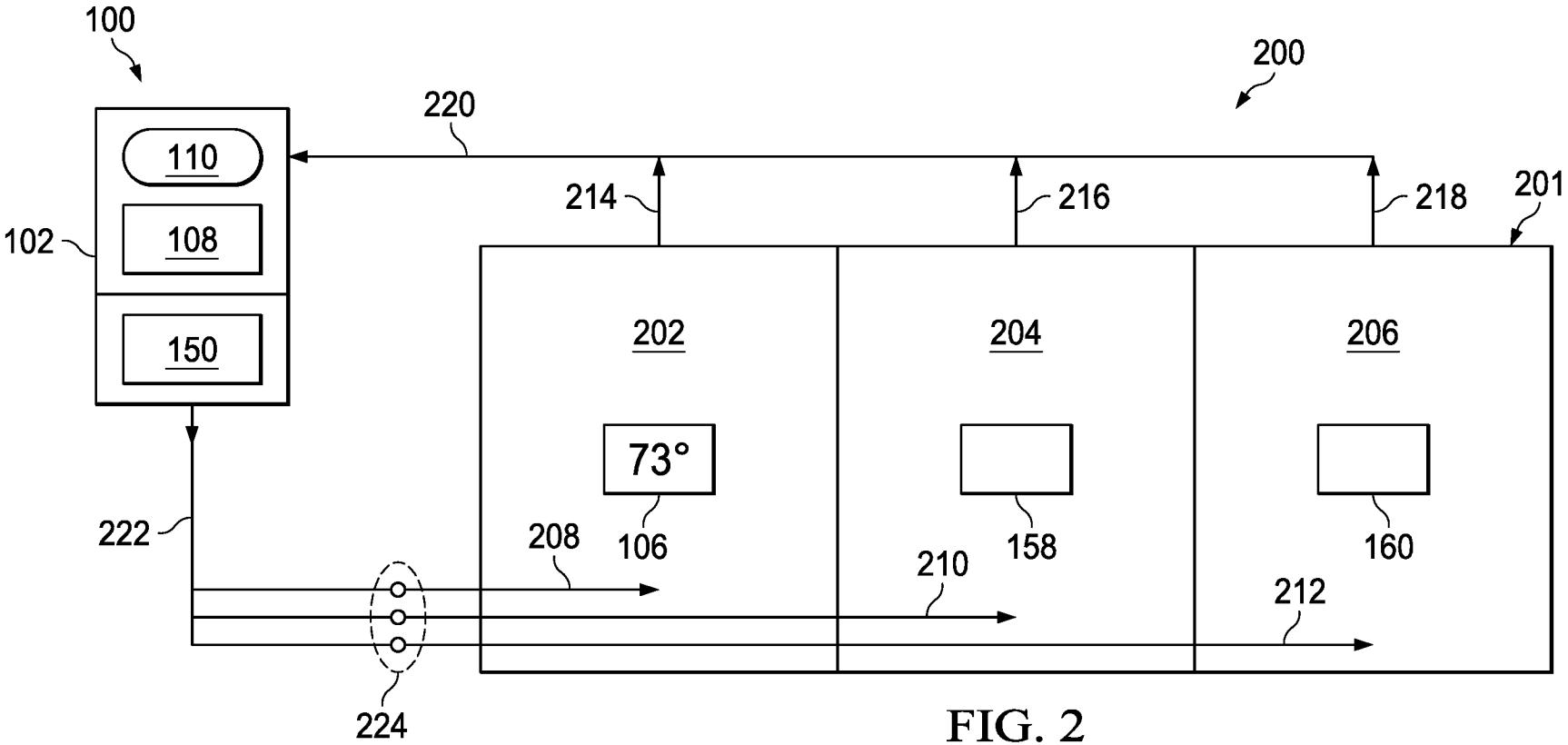
FIG. 2 is a schematic diagram of an air circulation path of the HVAC system of FIG. 1 according to an embodiment of the disclosure.

Referring now to FIG. 2, a schematic diagram of an air circulation path 200 of the HVAC system 100 of FIG. 1 is shown according to an embodiment of the disclosure. The HVAC system 100 of FIG. 1 may generally comprise an indoor fan 110 configured to circulate and/or condition air through a plurality of zones 202, 204, 206 of a structure 201. It will be appreciated that while three zones 202, 204, 206 are shown, any number of zones may be present in the structure 201. The air circulation path 200 of the HVAC system 100 may generally comprise a first zone supply duct 208, a second zone supply duct 210, a third zone supply duct 212, a first zone return duct 214, a second zone return duct 216, a third zone return duct 218, a main return duct 220, a main supply duct 222, a plurality of zone dampers 224, and an indoor unit 102 comprising an indoor heat exchanger 108, and an indoor fan 110. In some embodiments, the HVAC system 100 may also comprise a heat source 150. In some embodiments, the heat source 150 may comprise electrical resistance heating elements installed in the indoor unit 102. However, in other embodiments, the heat source 150 may comprise a furnace configured to burn fuel such as, but not limited to, natural gas, heating oil, propane, and/or any other suitable fuel, to generate heat. Further, in embodiments where the heat source 150 comprises a furnace, it will be appreciated that the furnace may also comprise an inducer blower substantially similar to the indoor fan 110 that may be configured to circulate an air-fuel mixture through the furnace.

Additionally, the HVAC system 100 may further comprise a zone thermostat 158 and a zone sensor 160. In some embodiments, a zone thermostat 158 may communicate with the system controller 106 and may allow a user to control a temperature setting, a humidity setting, and/or other environmental setting for the zone 202, 204, 206 in which the zone thermostat 158 is located. Further, the zone thermostat 158 may communicate with the system controller 106 to provide temperature, humidity, and/or other environmental feedback regarding the zone 202, 204, 206 in which the zone thermostat 158 is located. In some embodiments, a zone sensor 160 may also communicate with the system controller 106 to provide temperature, humidity, and/or other environmental feedback regarding the zone 202, 204, 206 in which the zone sensor 160 is located. Further, although only one zone thermostat 158 and one zone sensor 160 are shown, each of the zones 202, 204, 206 may comprise a zone thermostat 158 and/or a zone sensor 160.

The system controller 106 may be configured for bidirectional communication with any zone thermostat 158 and/or zone sensor 160 so that a user may, using the system controller 106, monitor and/or control any of the HVAC system 100 components regardless of which zones 202, 204, 206 the zone thermostat 158 and/or zone sensor 160 may be associated. Further, each system controller 106, each zone thermostat 158, and each zone sensor 160 may comprise a temperature sensor and/or a humidity sensor. As such, it will be appreciated that structure 201 is equipped with a plurality of temperature sensors and/or humidity sensors in the plurality of different zones 202, 204, 206. In some embodiments, a user may effectively select which of the plurality of temperature sensors and/or humidity sensors is used to control operation of the HVAC system 100. Thus, when at least one of the system controller 106, the zone thermostat 158, and the zone sensor 160 determines that a temperature and/or humidity of an associated zone has fallen outside either the temperature setting or the humidity setting, respectively, the system controller 106 may operate the HVAC system 100 in either the cooling mode or the heating mode to provide temperature conditioned air to at least one of the zones 202, 204, 206. Additionally the system controller 106 may also activate and/or operate the heat source 150 to provide heat and/or dehumidification while operating in the heating mode.

In operation, the indoor fan 110 may be configured to generate an airflow through the indoor unit 102 and/or the heat source 150 to deliver conditioned air from an air supply opening in the indoor unit 102, through the main supply duct 222, and to each of the plurality of zones 202, 204, 206 through each of the first zone supply duct 208, the second zone supply duct 210, and the third zone supply duct 212, respectively. Additionally, each of the first zone supply duct 208, the second zone supply duct 210, and the third zone supply duct 212 may comprise a zone damper 224 that regulates the airflow to each of the zones 202, 204, 206. In some embodiments, the zone dampers 224 may regulate the flow to each zone 202, 204, 206 in response to a temperature or humidity sensed by at least one temperature sensor and/or humidity sensor carried by at least one of the system controller 106, the zone thermostat 158, and the zone sensor 160.

Air from each zone 202, 204, 206 may return to the main return duct 220 through each of the first zone return duct 214, the second zone return duct 216, and the third zone return duct 218. From the main return duct 220, air may return to the indoor unit 102 through an air return opening in the indoor unit 102. Air entering the indoor unit 102 through the air return opening may then be conditioned for delivery to each of the plurality of zones 202, 204, 206 as described above. Circulation of the air in this manner may continue repetitively until the temperature and/or humidity of the air within the zones 202, 204, 206 conforms to a target temperature and/or a target humidity as required by at least one of the system controller 106, the zone thermostat 158, and/or the zone sensor 160.

Figure 3:
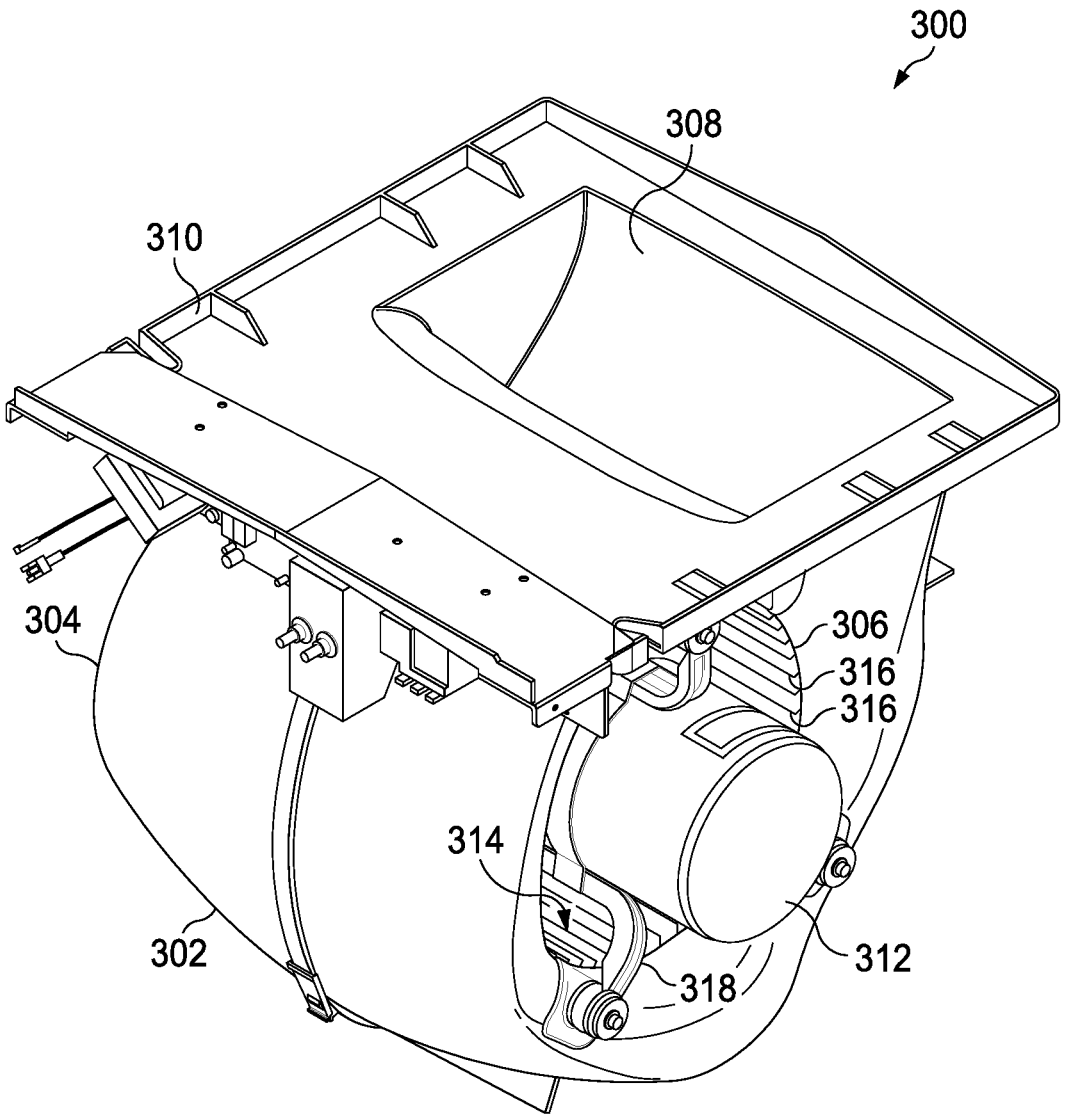
FIG. 3 is an oblique view of a blower assembly according to an embodiment of the disclosure.
Figure 4:
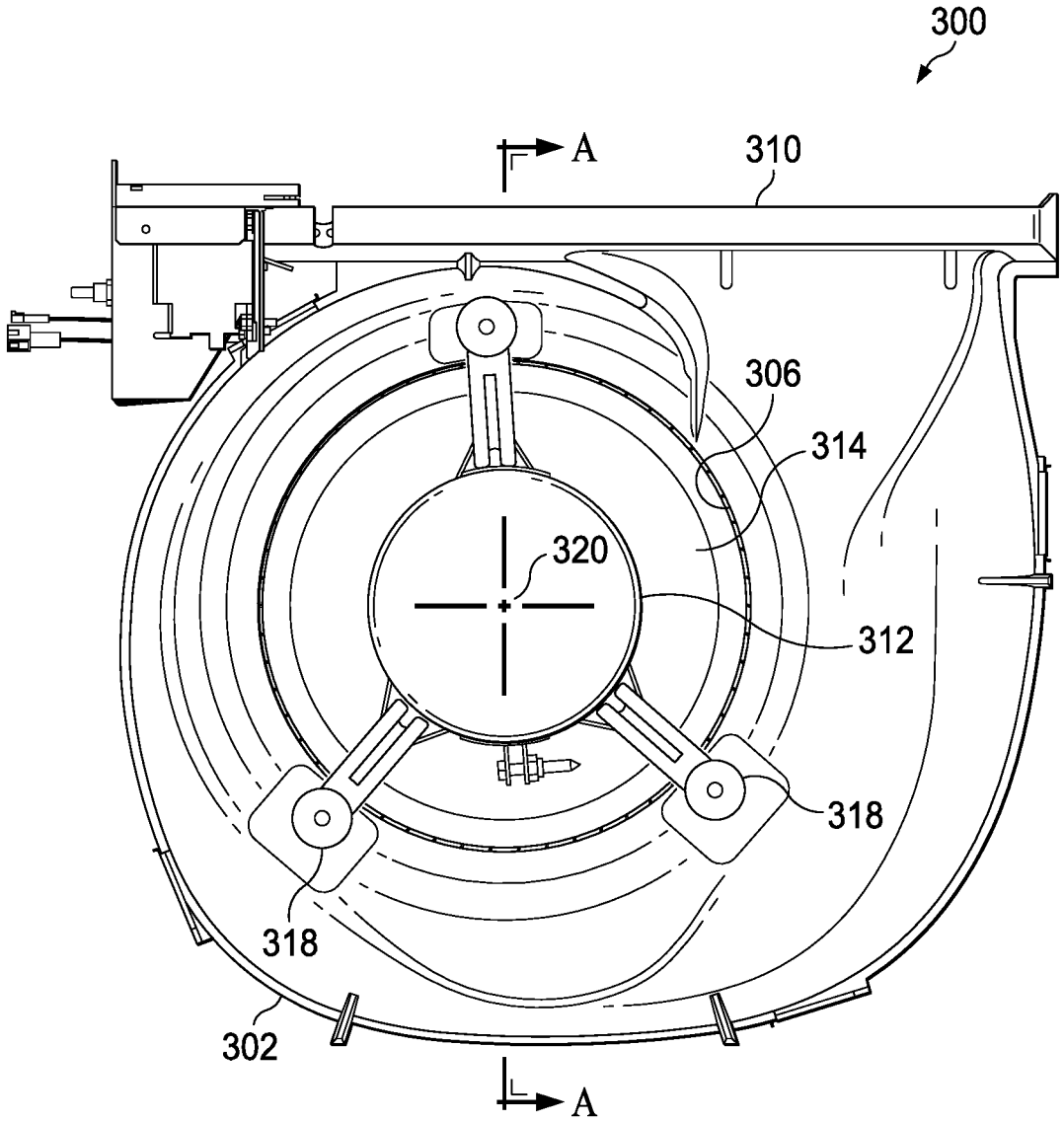
FIG. 4 is a orthogonal side view of the blower assembly of FIG. 3 according to an embodiment of the disclosure.

Referring now to FIGS. 3 and 4, an oblique view and an orthogonal side view of a blower assembly 300 are shown, respectively, according to an embodiment of the disclosure. Blower assembly 300 may generally be substantially similar to the indoor fan 110 of FIGS. 1 and 2 and be installed in an HVAC system 100 in a substantially similar manner to that of indoor fan 110 of FIGS. 1 and 2. Blower assembly 300 generally comprises a blower housing 302 comprising a left inlet 304, a right inlet 306, and an outlet 308 disposed through a blower deck 310. Blower assembly 300 also comprises a motor 312 comprising a shaft upon which an impeller 314 comprising a plurality of fan blades 316 disposed about the impeller 314 are mounted. Additionally, the motor 312 may be secured to the blower housing 302 via a plurality of mounts 318. A primary function of the blower housing 302 is to receive at least a portion of each of the motor 312 and the impeller 314 while also defining an airflow path between each of the opposing left inlet 304 and right inlet 306 of the blower housing 302 and the outlet 308 of the blower housing 302. Further, it will be appreciated that in some embodiments, the blower deck 310 of the blower housing 302 may be used to mount the blower assembly 300.

In operation, the motor 312 may be operated to selectively rotate the impeller 314 about an axis of rotation 320 of the shaft of the motor 312. The selective rotation of the impeller 314 and the configuration of the blades 316 of the impeller 314 may generally draw an intake of air into the blower housing 302 through the left inlet 304 and/or the right inlet 306 and create a static pressure within the blower housing 302. The buildup of static pressure within the blower housing 302 may generate an airflow through the blower housing 302 by forcing the air received via the left inlet 304 and/or the right inlet 306 through the blower housing 302 along an internal flow path of the blower housing 302, whereby the airflow may exit the blower housing 302 through the outlet 308 of the blower housing 302. After leaving the outlet 308 of the blower housing 302, the airflow may selectively be passed through components of the HVAC system 100 of FIGS. 1 and 2.

Figure 5:
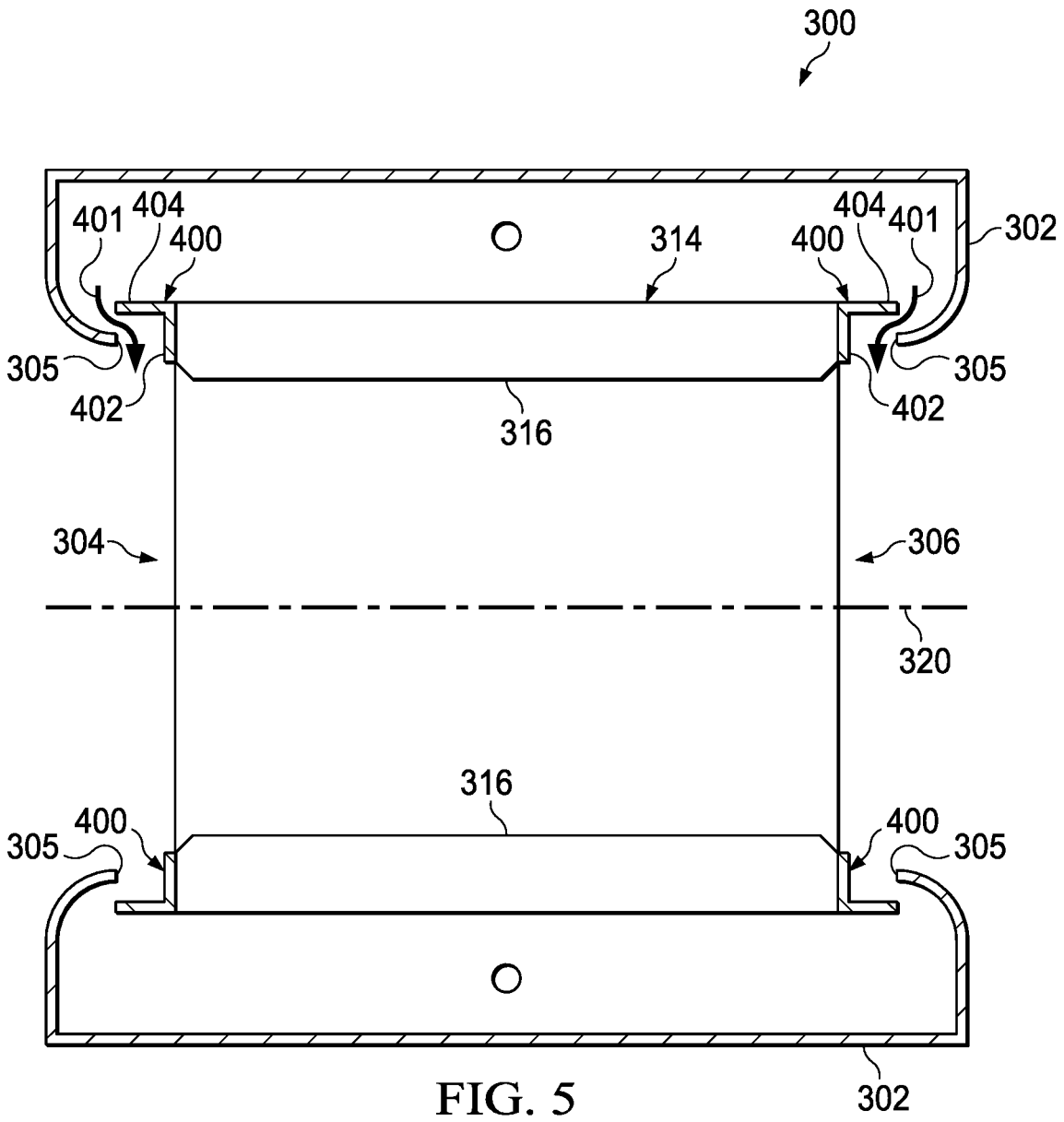
FIG. 5 is a partial cross-sectional view of the blower assembly of FIGS. 3 and 4 taken along cutting line A-A of FIG. 4 according to an embodiment of the disclosure.

Referring now to FIG. 5, a partial cross-sectional view of the blower assembly 300 of FIGS. 3 and 4 taken along cutting line A-A of FIG. 4 is shown according to an embodiment of the disclosure. In this embodiment, the blower assembly 300 comprises a labyrinth seal 400. The labyrinth seal 400 comprises a base 402 and an inner flange 404 that extends from the base 402 to collectively form an outer circular rim of the impeller 314 to which the blades 316 of the impeller 314 are affixed. More specifically, at least in some embodiments, the blades 316 may be affixed to the base 402 of the labyrinth seal 400. In some embodiments, the blades 316 and the labyrinth seal 400 may be formed from a sheet metal compound and be crimped, welded, molded around, and/or otherwise joined to collectively form the impeller 314. However, in other embodiments, the labyrinth seal 400 may be formed from an elastomeric compound, plastic, and/or any other material and be joined to the blades 316 of the impeller 314 and/or an outer surface of an existing impeller via adhesive, molding, rivets, and/or any other fastening means to collectively form the impeller 314.

The base 402 and the inner flange 404 may generally comprise a substantially L-shaped cross-sectional profile. The base 402 may generally be oriented substantially perpendicular to the axis of rotation 320 of the impeller 314 and the shaft of the motor 312, while the inner flange 404 may be oriented substantially parallel to the axis of rotation 320 of the impeller 314 and the shaft of the motor 312. However, in other embodiments, the inner flange 404 may be oriented at an angle to the axis of rotation 320 of the impeller 314 and the shaft of the motor 312. The inner flange 404 may generally be disposed within the blower housing 302, such that the inner flange 404 is disposed further from the axis of rotation 320 as compared to ends 305 of the blower housing 302 that form each of the left inlet 304 and the right inlet 306. In some embodiments, the inner flange 404 may comprise a substantially similar axial dimension along the axis of rotation 320 as the ends 305 of each of the left inlet 304 and right inlet 306 of the blower housing 302. However, in other embodiments, the inner flange 404 may extend axially into the blower housing 302 beyond the ends 305 of the blower housing 302 that form each of the left inlet 304 and the right inlet 306.

When the impeller 314 is disposed within the blower housing 302, the labyrinth seal 400 may generally form a tortuous leakage airflow path 401 between the impeller 314 and the blower housing 302. More specifically, the inner flange 404 and the base 402 of the labyrinth seal 400 in combination with the ends 305 of each of the left inlet 304 and the right inlet 306 create the tortuous leakage airflow path 401 between the impeller 314 and the blower housing 302. When the impeller 314 is selectively rotated by the motor 312 and an intake of air is drawn into the blower housing 302 through the left inlet 304 and/or the right inlet 306, a static pressure is created within the blower housing 302. Traditionally, the static pressure within the blower housing 302 may cause leakage between the blower housing 302 and the impeller 314. However, the labyrinth seal 400 generally causes air that traditionally leaks between a blower housing and an impeller to navigate the tortuous leakage airflow path 401 that is not a straight path in order to escape from the blower housing 302 without passing through the outlet 308. The labyrinth seal 400 thereby may increase a pressure drop of air passing through the tortuous leakage airflow path 401, making it harder for air to escape through the tortuous leakage airflow path 401, which may substantially reduce the amount of air that escapes from the blower housing 302 between the blower housing 302 and the impeller 314 to provide an increased efficiency as compared to traditional blower assemblies.

In some embodiments, the labyrinth seal 400 may reduce leakage between the blower housing 302 and the impeller 314 by at least about 1%, at least about 2%, at least about 3%, at least about 5%, at least about 10%, at least about 15%, and/or at least about 20%. In some embodiments, the reduction in leakage between the blower housing 302 and the impeller 314 may provide an increased blower assembly 300 efficiency by at least about 1%, at least about 2%, at least about 3%, at least about 5%, and/or at least about 10%. Furthermore, by increasing the efficiency of the blower assembly 300, the labyrinth seal 400 may further provide an increase in the overall efficiency of an HVAC system 100. It will be appreciated that while the labyrinth seal 400 provides the tortuous leakage airflow path 401 that substantially reduces the amount of air that escapes from the blower housing 302 between the blower housing 302 and the impeller 314, the labyrinth seal 400 still allows the blower assembly 300 to maintain necessary clearances between the ends 305 of each of the left inlet 304 and the right inlet 306 of the blower housing and the impeller 314 and/or the labyrinth seal 400. Accordingly, despite the labyrinth seal 400 making it harder for air to escape from the blower housing 302 through the tortuous leakage airflow path 401, manufacturing tolerances are maintained that ensure there is no contact between the impeller 314 and the blower housing 302 during operation of the blower assembly 300. Said differently, while the labyrinth seal 400 is described as comprising the base 402 and the inner flange 404, it will be appreciated that the labyrinth seal 400 may also comprise at least a portion of the blower housing 302 (e.g. ends 305) such that the blower housing 302 and the base 402 and the inner flange 404 of the impeller 314 form the labyrinth seal 400.

Figure 6:
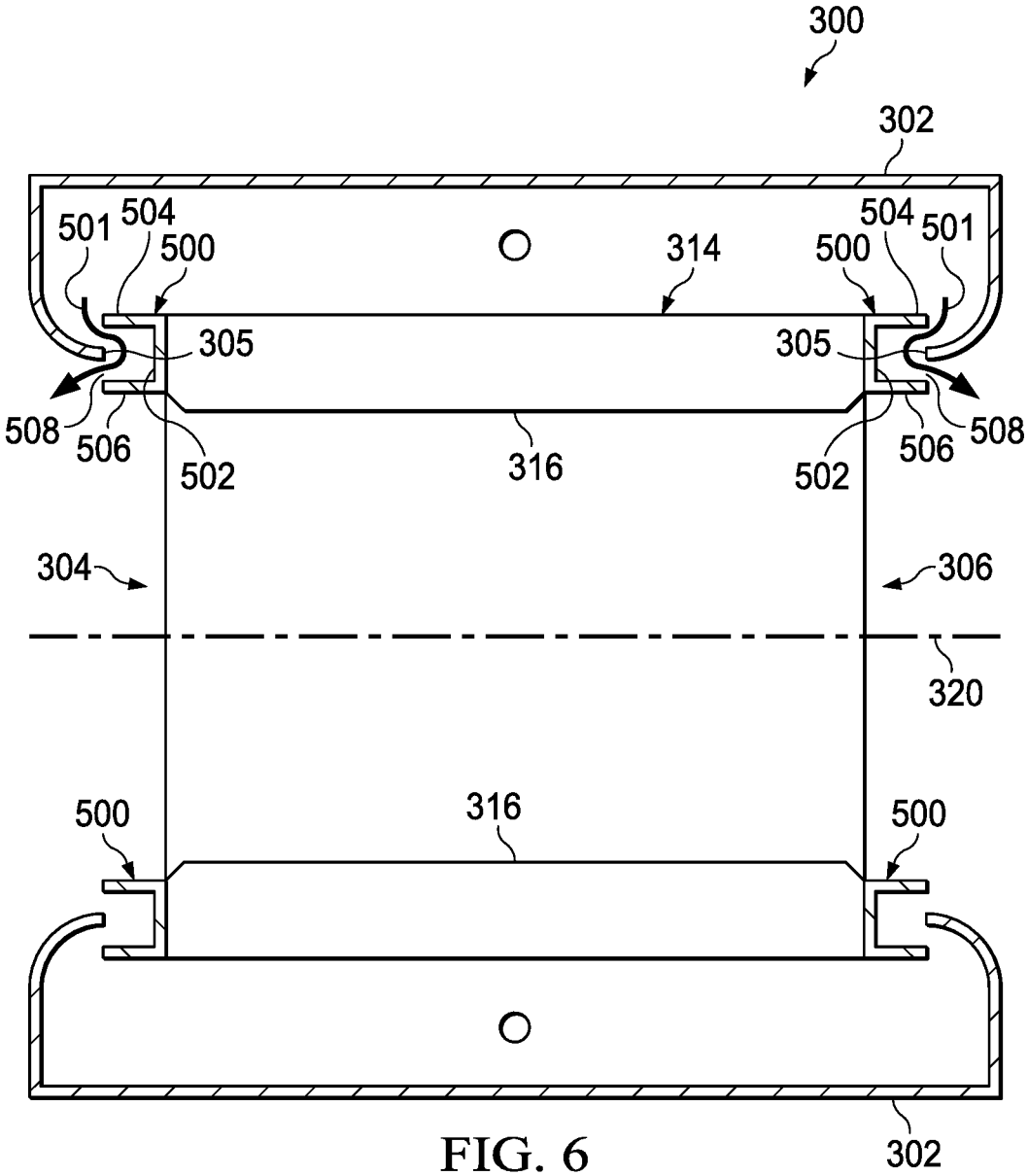
FIG. 6 is a partial cross-sectional view of the blower assembly of FIGS. 3 and 4 taken along cutting line A-A of FIG. 4 according to another embodiment of the disclosure.

Referring now to FIG. 6, a partial cross-sectional view of the blower assembly 300 of FIGS. 3 and 4 taken along cutting line A-A of FIG. 4 is shown according to another embodiment of the disclosure. In this embodiment, the blower assembly 300 comprises a labyrinth seal 500. Labyrinth seal 500 may generally be substantially similar to labyrinth seal 400 of FIG. 4 and comprise a base 502 and an inner flange 504 that are substantially similar to the base 402 and the inner flange 404, respectively, of FIG. 5. However, labyrinth seal 500 also comprises an outer flange 506. The outer flange 506 may generally extend from the base 502 and be disposed outside of the blower housing 302 and at least partially within each of the left inlet 304 and the right inlet 306, such that the outer flange 506 is disposed closer to the axis of rotation 320 as compared to ends 305 of the blower housing 302 that form each of the left inlet 304 and the right inlet 306. Additionally, the base 502, the inner flange 504, and the outer flange 506 may generally comprise a substantially U-shaped cross-sectional profile.

Most generally, the base 502 and the inner flange 504 may generally be oriented substantially similar to the base 402 and the inner flange 404, respectively, of FIG. 5. In some embodiments, the outer flange 506 may generally be oriented substantially parallel to the axis of rotation 320 of the impeller 314 and the shaft of the motor 312. However, in other embodiments, the outer flange 506 may be oriented at an angle to the axis of rotation 320 of the impeller 314 and the shaft of the motor 312. In some embodiments, the outer flange 506 may comprise a substantially similar axial dimension along the axis of rotation 320 as the inner flange 504 and/or the ends 305 of each of the left inlet 304 and right inlet 306 of the blower housing 302. However, in other embodiments, the outer flange 506 may extend axially along the axis of rotation 320 beyond the inner flange 504 and/or the ends 305 of the blower housing 302 that form each of the left inlet 304 and the right inlet 306 of the blower housing 302. In yet alternative embodiments, the outer flange 506 may comprise a shorter axial dimension along the axis of rotation 320 as compared to the inner flange 504 and/or the ends 305 of each of the left inlet 304 and right inlet 306 of the blower housing 302.

When the impeller 314 is disposed within the blower housing 302, the labyrinth seal 500 may generally form a tortuous leakage airflow path 501 between the impeller 314 and the blower housing 302. More specifically, the inner flange 504, the base 502, and the outer flange 506 of the labyrinth seal 500 in combination with the ends 305 of each of the left inlet 304 and the right inlet 306 create the tortuous leakage airflow path 501 between the impeller 314 and the blower housing 302. When the impeller 314 is selectively rotated by the motor 312 and an intake of air is drawn into the blower housing 302 through the left inlet 304 and/or the right inlet 306, a static pressure is created within the blower housing 302. Similarly to the labyrinth seal 400 of FIG. 5, the labyrinth seal 500 generally causes air that traditionally leaks between a blower housing and an impeller to navigate the tortuous leakage airflow path 501 in order to escape from the blower housing 302 without passing through the outlet 308. The labyrinth seal 500 thereby may increase a pressure drop of air passing through the tortuous leakage airflow path 501, making it harder for air to escape through the tortuous leakage airflow path 501, which may substantially reduce the amount of air that escapes from the blower housing 302 between the blower housing 302 and the impeller 314 to provide an increased efficiency as compared to traditional blower assemblies.

By providing the outer flange 506 in the labyrinth seal 500, the tortuous leakage airflow path 501 is further complicated as compared to the tortuous leakage airflow path 401 of FIG. 5. In part, this may be attributed to the extra turn that the air must make as compared to the tortuous leakage airflow path 401 of FIG. 5 when air escapes from the blower housing 302 between the blower housing 302 and the impeller 314. However, by providing the outer flange 506, an outlet 508 of the tortuous leakage airflow path 501 is oriented in a substantially opposing direction as compared to the intake of air entering the blower housing 302 through each of the left inlet 302 and the right inlet 306. Accordingly the outlet 508 of the tortuous leakage airflow path 501 faces the incoming airflow entering the blower housing 302 through each of the left inlet 302 and the right inlet 306. As such, the pressure at the outlet 508 of the tortuous leakage airflow path 501 may be substantially equal to the total pressure at the inlets 304, 306 due to the blower assembly 300 having a high intake velocity. Therefore, the pressure driving the leakage through the tortuous leakage airflow path 501 may be reduced, thereby further reducing the amount of leakage from the blower housing 302 between the blower housing 302 and the impeller 314 to provide an increased efficiency as compared to traditional blower assemblies.

In some embodiments, the labyrinth seal 500 may reduce leakage between the blower housing 302 and the impeller 314 by at least about 1%, at least about 2%, at least about 3%, at least about 5%, at least about 10%, at least about 15%, and/or at least about 20%. In some embodiments, the reduction in leakage between the blower housing 302 and the impeller 314 may provide an increased blower assembly 300 efficiency by at least about 1%, at least about 2%, at least about 3%, at least about 5%, and/or at least about 10%. Furthermore, by increasing the efficiency of the blower assembly 300, the labyrinth seal 500 may further provide an increase in the overall efficiency of an HVAC system 100. Furthermore, it will be appreciated that while the labyrinth seal 500 provides the tortuous leakage airflow path 501 that substantially reduces the amount of air that escapes from the blower housing 302 between the blower housing 302 and the impeller 314, the labyrinth seal 500 still allows the blower assembly 300 to maintain necessary clearances between the ends 305 of each of the left inlet 304 and the right inlet 306 of the blower housing 302 and the impeller 314 and/or the labyrinth seal 500. Accordingly, despite the labyrinth seal 500 making it harder for air to escape from the blower housing 302 through the tortuous leakage airflow path 501, manufacturing tolerances are maintained that ensure there is no contact between the impeller 314 and the blower housing 302 during operation of the blower assembly 300. Said differently, while the labyrinth seal 500 is described as comprising the base 502 and the inner flange 504, it will be appreciated that the labyrinth seal 500 may also comprise at least a portion of the blower housing 302 (e.g. ends 305) such that the blower housing 302 and the base 502 and the inner flange 504 of the impeller 314 form the labyrinth seal 500.

While several embodiments have been provided in the present disclosure, and the labyrinth seal 400, 500 has been discussed in terms of a single labyrinth seal 400, 500, it will be appreciated that the labyrinth seals 400, 500 are formed on each of a left side and a right side of the impeller 314 to form a singular, continuous labyrinth seal 400, 500 that creates the tortuous leakage airflow paths 401, 501, respectively, around an entire outer periphery of the impeller 314 on each of the left side and the right side of the impeller 314. It will be appreciated that the tortuous leakage airflow paths 401, 501 provide a more restrictive flowpath between the blower housing 302 and the impeller 314 to reduce leakage of air from the blower housing 302 between the blower housing 302 and the impeller 314.

Furthermore, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented. In some embodiments, a blower assembly 300 comprising labyrinth seals 400, 500 may be a component of an air handling unit, such as indoor unit 102 of HVAC system 100 of FIGS. 1 and 2. However, in some embodiments, the blower assembly 300 comprising the labyrinth seals 400, 500 may be a component of a gas-fired furnace, such as the heat source 150 of HVAC system 100 of FIG. 2. In yet other embodiments, the blower assembly 300 comprising the labyrinth seals 400, 500 may be a component of any other component and/or system of an HVAC system 100 that requires an airflow (e.g. geothermal heat pump systems, automotive HVAC systems, and/or any other system, device, and/or component that requires a fan to generate an airflow).

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Unless otherwise stated, the term "about" shall mean plus or minus 10 percent of the subsequent value.

Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A blower assembly, comprising:

a blower housing; and an impeller comprising blades and configured to rotate about an axis, wherein a blade includes a first flange and a second flange that each extend substantially parallel to the axis, wherein an end of the blower housing extends in a direction between the first flange and the second flange; and a labyrinth seal comprising a tortuous leakage airflow path between the first flange, the second flange, and the end of the blower housing.

2. The blower assembly of claim 1, wherein the labyrinth seal is configured to prevent at least a portion of airflow from the blower housing from escaping the blower housing between the blower housing and the impeller.

3. The blower assembly of claim 1, wherein the blower housing comprises a blower deck comprising an outlet, wherein the labyrinth seal is configured to direct airflow through the tortuous leakage airflow path to allow the airflow to escape from the blower housing without passing through the outlet of the blower deck.

4. The blower assembly of claim 1, wherein the labyrinth seal is configured to increase a pressure drop of air passing through the tortuous leakage airflow path to reduce a leakage of air from the blower housing and through the tortuous leakage airflow path.

5. The blower assembly of claim 1, wherein an outlet of the labyrinth seal is oriented in a direction substantially opposing a direction of an airflow entering the blower housing.

6. The blower assembly of claim 1, further comprising a base coupling the first flange to the second flange, wherein the base extends between the second flange and the first flange in a direction that is substantially perpendicular to the axis.

7. The blower assembly of claim 6, wherein the second flange and the first flange have substantially equal lengths along the axis.

8. The blower assembly of claim 1, wherein the labyrinth seal is configured to increase an efficiency of the blower assembly by reducing an amount of air that escapes through the tortuous leakage airflow path.

9. The blower assembly of claim 1, wherein the blower assembly is a component of an air handling unit and configured to generate an airflow through the air handling unit.

10. The blower assembly of claim 1, wherein the blower assembly is a component of a furnace and configured to generate an airflow through the furnace.

11. A heating, ventilation, and/or air conditioning (HVAC) system, comprising:

a component; and a blower assembly configured to generate an airflow through the component, the blower assembly comprising:

a blower housing;

an impeller comprising blades and configured to rotate about an axis, wherein a blade includes a first flange and a second flange that each extend substantially parallel to the axis, wherein an end of the blower housing extends in a direction between the first flange and the second flange; and a labyrinth seal comprising a tortuous leakage airflow path between the first flange, the second flange, and the end of the blower housing.

12. The HVAC system of claim 11, wherein the labyrinth seal is configured to prevent at least a portion of the airflow from the blower housing from escaping the blower housing between the blower housing and the impeller.

13. The HVAC system of claim 11, further comprising a base coupling the first flange to the second flange, wherein the base extends between the second flange and the first flange in a direction that is substantially perpendicular to the axis.

14. The HVAC system of claim 13, wherein an outlet of the labyrinth seal is oriented in a direction substantially opposing a direction of an airflow entering the blower housing.

15. The HVAC system of claim 11, wherein the component is at least one of an air handling unit and a furnace.

16. The HVAC system of claim 11, wherein the second flange and the first flange have substantially equal lengths along the axis.

17. A heating, ventilation, and/or air conditioning (HVAC) system comprising:

a blower housing and an impeller comprising blades and configured to rotate about an axis, wherein a blade includes a first flange and a second flange each extending substantially parallel to the axis, wherein an end of the blower housing extends in a direction between the first flange and the second flange;

a base coupling the first flange to the second flange; and a labyrinth seal comprising a tortuous leakage airflow path between the first flange, the base, the second flange, and the end of the blower housing.

18. The HVAC system of claim 17, wherein the first flange, the base, and the second flange collectively comprise a U-shaped cross-sectional profile.

19. The HVAC system of claim 17, wherein the base extends between the second flange and the first flange in a direction that is substantially perpendicular to the axis.

20. The HVAC system of claim 19, wherein the second flange and the first flange have substantially equal lengths along the axis.

* * * * *